US005386399A

United States Patent [19]

Masaki

[11] Patent Number: 5,386,399

[45] Date of Patent: Jan. 31, 1995

[54] ANALOGUE ELECTRONIC TIMEPIECE WITH CHRONOGRAPHIC FUNCTION

[75] Inventor: Hiroyuki Masaki, Tokyo, Japan

[73] Assignee: Seiko Instruments Inc., Japan

[21] Appl. No.: 163,570

[22] Filed: Dec. 8, 1993

[30] Foreign Application Priority Data

Mar. 16, 1993 [JP] Japan ..... 5-56204

[51] Int. Cl.[6] ..... G04F 8/00

[52] U.S. Cl. ..... 368/110; 368/113

[58] Field of Search ..... 368/107–113

[56] References Cited

U.S. PATENT DOCUMENTS

| | | | |
|---|---|---|---|
| 4,523,857 | 6/1985 | Ushikoshi | 368/157 |
| 4,537,514 | 8/1985 | Moriya | 368/107 |
| 4,657,405 | 4/1987 | Nakazawa | 368/110 |
| 4,901,294 | 2/1990 | Aihara | 368/63 |
| 5,151,885 | 9/1992 | Kasuo | 368/110 |

*Primary Examiner*—Vit W. Miska

*Attorney, Agent, or Firm*—Bruce L. Adams; Van C. Wilks

[57] ABSTRACT

An analog electronic timepiece comprises a system control circuit for outputting a control signal to each operable circuit in response to a signal from an outer input switch, a chronograph storing circuit for storing the value a chronograph measuring means by a lap control signal outputted from the system control circuit, a lap time calculating circuit to which a measuring data of the chronograph measuring circuit and a former measuring data stored in the chronograph storing circuit by a former lap control signal are inputted for calculating the time difference between the above two data and outputting a correcting drive signal if the hand requires a correcting drive as a result of the above calculation and a drive judging circuit to which a lap input signal, an interruption signal, and a correcting drive signal outputted from the system control circuit are inputted for outputting a data of the drive number if the hand requires driving.

11 Claims, 8 Drawing Sheets

ANALOGUE ELECTRONIC TIMEPIECE WITH CHRONOGRAPHIC FUNCTION

BACKGROUND OF THE INVENTION

The present invention relates to an analog electronic timepiece with chronographic function, and in particular relates to a chronographic lap calculating circuit and hand driving control circuit for measuring a lap time during chronographic measurement.

In the past, conventional analog multifunction electronic timepieces display the elapsed time designated a split time hereinafter, however none display the time between two points of measurement designated a lap time hereinafter while the time is measured.

Explanation will be given about a split time and a lap time in detail. FIG. 2 is an explanatory diagram for explaining the function of the split and the lap measurements. Suppose that switching operation is performed three times after chronographic measurement starts in FIG. 2.

When a first switching operation occurs both a split time and a lap time indicate the time between the start and the first switching operation.

When a second switching operation occurs, a split time indicates the total time from start to the second switching operation, SPLIT2. On the other hand, lap time indicates the time between the first switching operation and the second switching operation, LAP2.

Furthermore, a split time and a lap time at each of three switching operation are shown in FIG. 2.

Namely, a split time indicates the total time from the start of the chronographic operation to the ultimate switching operation, and the lap time indicates the time between the two switching operations which are adjacent to each other.

Thus, when the switching operations are performed n times, the relationship between split time and lap time is governed by the following formula (1) is always valid.

SPLIT(n)=LAP1+LAP2+. . .+LAP(n) . . . the formula(1)

The chronographic measurement is usually performed by the following operation.

An outer operating member starts to activate the timepiece, then an interrupting, or interrupt signal generating means for the chronograph is activated so as to generate interrupting, or interrupt signals at equal intervals of an arbitrary time.

There are usually two kind of interrupting signals and their time intervals are 1/10 second and 1 second, or 1/100 second and 1/10 second.

The chronograph measurement is performed by counting these interrupting signals with a counter and so on.

Particularly, in case of an electronic timepiece having an analog display, a hand driving control operation is periodically performed in order to move a hand to a position in a dial corresponding to the value indicated by the counter per 1/10 second or one second intervals depending upon the technical capability of the timepiece.

The value less than the unit of the interrupting signal is separately read in a chronograph hard counter etc. so as to display directly, or this function is not provided according to the technical specification of the product.

However, when a lap time is measured by accumulating interrupting signals, it is sometimes incorrectly measured as a value greater than its true value on account of the timing of the switching input. This is due to the fact that interrupt signals are generated in accordance with the passage of actual time and the issuance of interrupting signals is not synchronized with the commencement of a lap measurement.

This problem is illustrated by FIG. 3 which shows driving quantity of two cases of which the timing of switching input in response to an interrupting timing differ with each other.

In cases that are two complete interrupt cycles between an initial switching input and a final switching input. Thus, in both cases the time piece should display a lap time comprising two interruptions (two drive parts). Indeed this is true for case 1, wherein the two interrupt cycles occur between switching inputs A and C.

As for the case 2, however, switching input B is inputted just before the interruption 1 and as a result the drive 1 corresponding to the interruption 1 is performed at once. Consequently, rather than being performed for two interrupt periods, drive is performed for three interruptions in total until the next switching input C occurs. Therefore there exists a problem that the measured lap time data differs from the displaying lap time data.

It is possible to display a measured data correctly by setting back the hand which drives too much with a lap time calculation when the switching input C is inputted. However, such an operation requires a hand reversion driving circuit and at the same time, it is hard for a user to trust the displayed measurement of an electronic timepiece moving as described above.

If the chronograph interruption generating means and chronograph measuring means are restarted every switching input, it can be prevented that the hand drives too much. However, a problem occurs at the same time that the total time from the start is difficult to display when a measurement is finished.

SUMMARY OF THE INVENTION

An object of the present invention is to provide an analog electronic timepiece which displays a lap time correctly without the need for a hand reversion driving circuit or for resetting the chronograph interruption generating means and the chronograph measuring at each switching input. Another object of the present invention is to prohibit the hand from driving for a first chronograph interruption period in each lap time measurement. Additionally, is it another object of the present invention calculates the time difference between an immediately preceding chronograph measurement and the present chronograph measurement, and if there is a difference between the lap time indicated by the hand and the result of the calculation at that instant, to correct the data indicated by the hand so as to correspond to the result of the calculation.

In order to achieve these objectives and others as shown in FIG. 1, control signals B, C, and D are outputted by system control means in response to a signal A inputted by an outer inputting means 1 for activating each system of the electronic timepiece.

A chronograph interrupting signal generating means 3 issues an interrupt signal E for chronographic measurement in response to the interruption control signal C outputted by a system control means 2.

A chronograph measuring means 4 counts the interrupting signal E outputted by the chronograph interrupting signal generating means 3 so as to perform chronograph measurement.

The chronograph measuring means 4 outputs chronographic measurement data to a chronograph storing means 5 and a lap time calculating means 6 in response to a lap input signal B.

The chronograph storing means 5 stores the latest data of chronograph measurement.

The chronograph storing means 5 outputs the former data of chronographic measurement stored in the lap time calculating means 6 in response to the lap input signal B outputted from the system control means 2.

The lap time calculating means 6 calculates a lap time from the former and the latest data of chronographic measurement, which are inputted from the chronograph measuring means 4 and the chronograph storing means 5, in response to the lap control signal B outputted from the system control means 2. As a result, if correcting drive of the hand is necessary, the lap time calculating means 6 outputs a correcting drive signal F to a drive judging means 8.

The lap control signal B outputted from the system control means 2, the correcting drive signal F outputted from the lap time calculating means 6, and the chronograph interruption signal E are all inputted to the drive judging means 8. Then the drive judging means 8 calculates the drive number of the hand, judges whether drive is necessary and outputs the data of the drive number to a driving means 12 only when drive is necessary.

The lap control signal B outputted from the system control means 2, a reset input signal D, and the data of the drive number outputted from the drive judging means 8 are all inputted to the driving means 12. The driving means 12 actually controls the hands.

The inventive electronic timepiece with chronographic function can drive a hand which is delayed from the actual lap data by one interruption of period the chronograph interrupting signal E.

Further, the inventive electronic timepiece with chronographic function can display a correct lap data because it conducts correcting drive during a lap operation if necessary.

DETAILED DESCRIPTION OF THE PREFERRED EMBODIMENTS

An embodiment of the present invention will be described with reference to the drawings.

Figure 1:
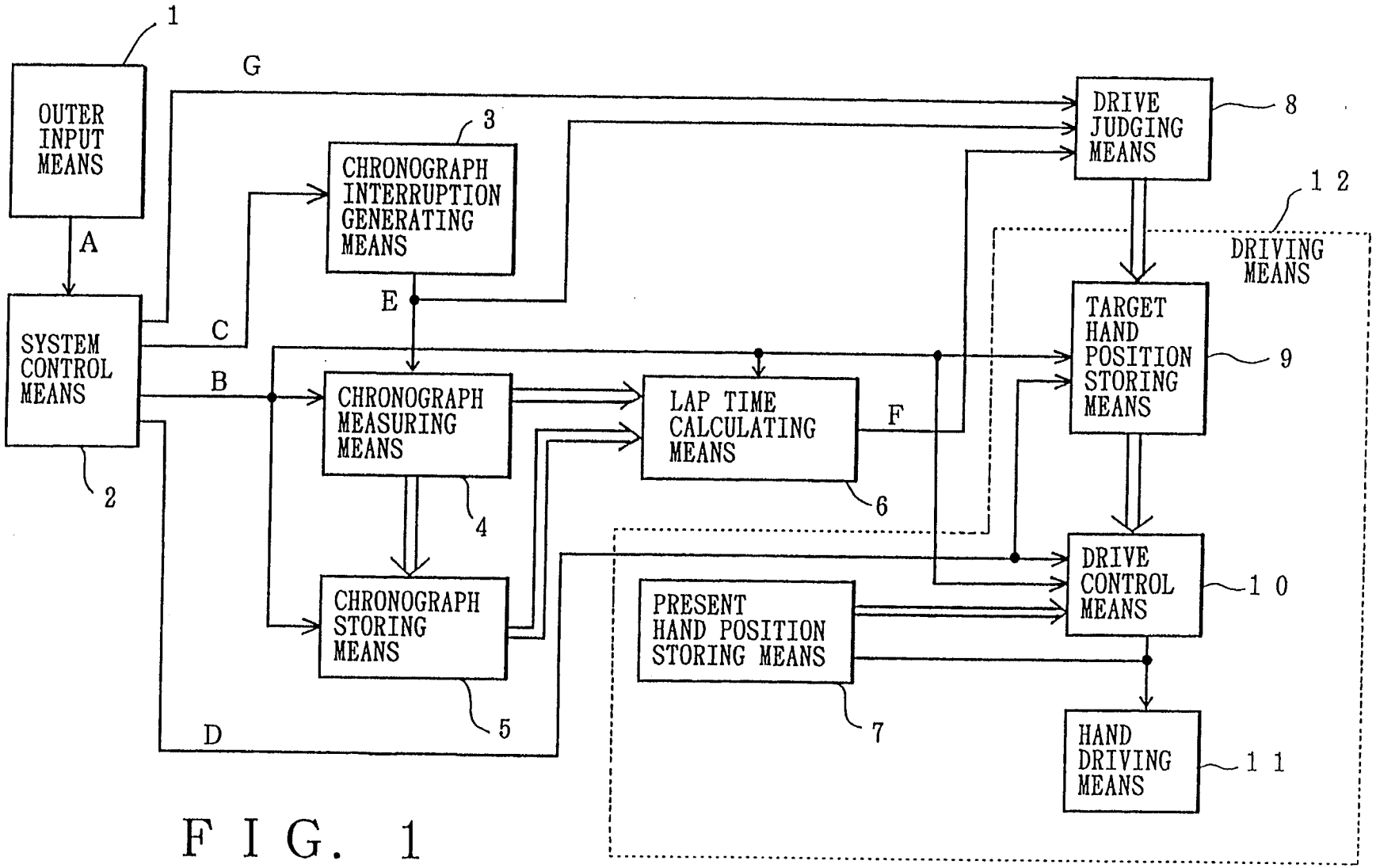
FIG. 1 is a function block diagram showing one example of a chronographic timepiece according to the present invention.
Figure 2:
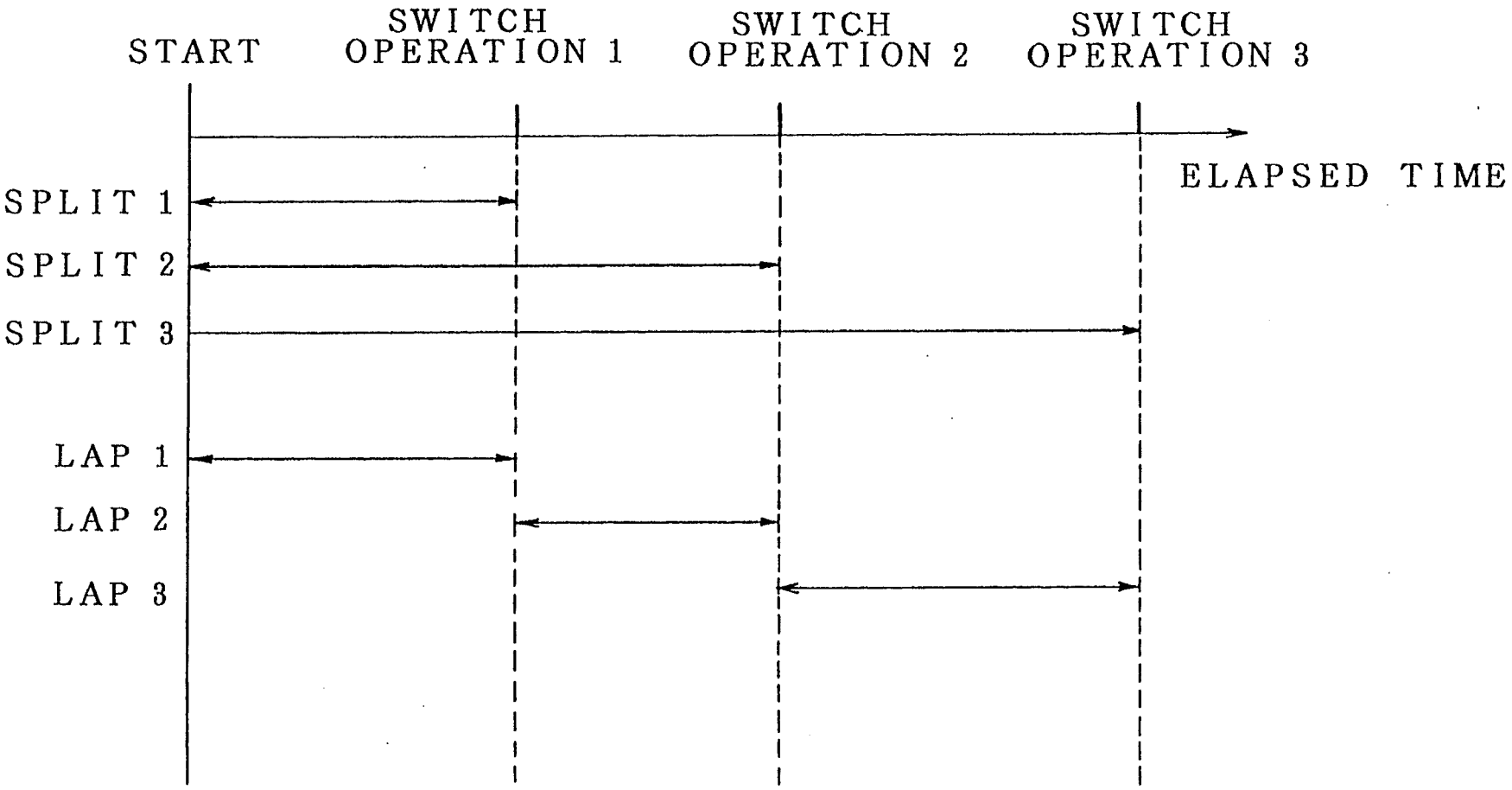
FIG. 2 is an explanatory diagram illustrating the split and lap according to the present invention.
Figure 3:
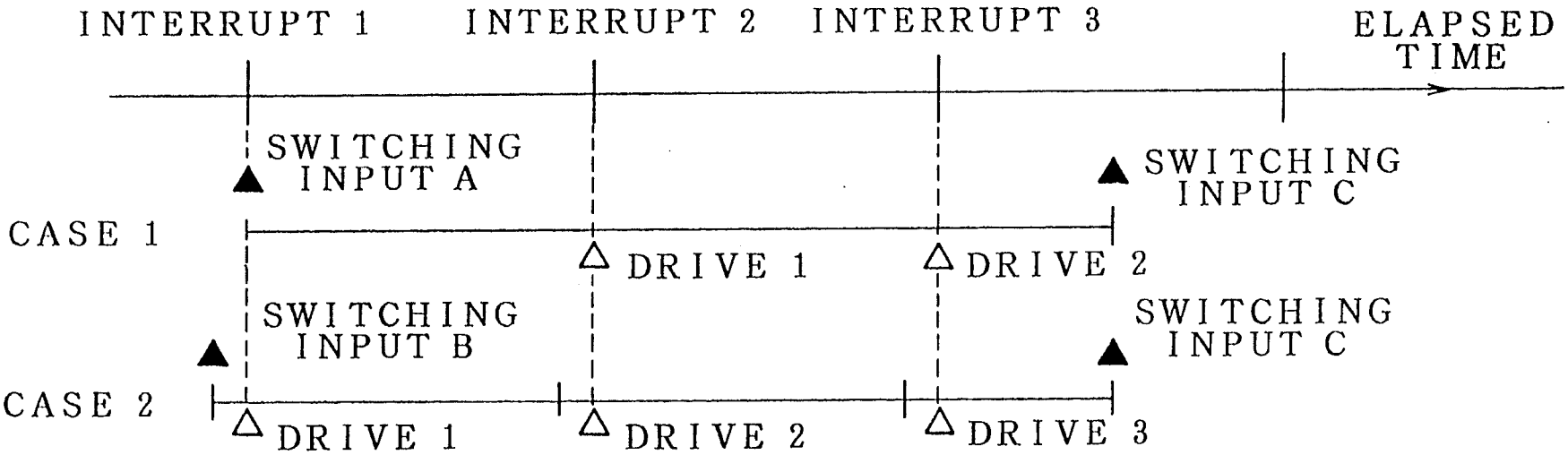
FIG. 3 is a timing diagram showing lap operation according to the present invention.
Figure 4:
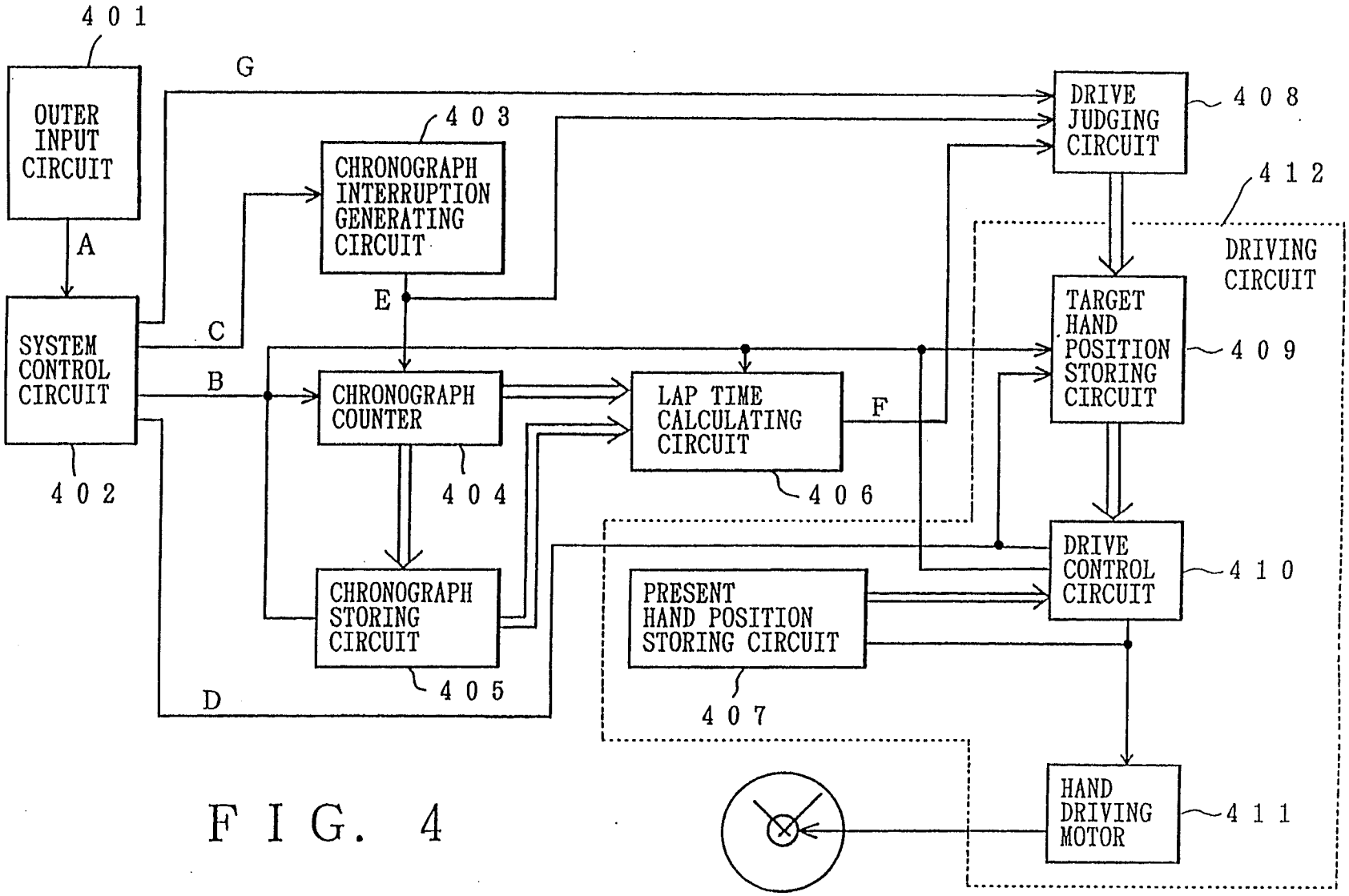
FIG. 4 is a block diagram of an embodiment of the inventive electronic timepiece.

FIG. 4 is a circuit diagram .showing an embodiment of the inventive electronic timepiece. A direction to start chronographic measurement is inputted from an outer input switch 401 such as a button switch.

A system control circuit 402 judges an inputted signal A to be a start or a stop or a lap signal and so on, and then outputs appropriate control signals to a chronograph interruption generating circuit 403, chronograph counter 404, a chronograph storing circuit 405, a drive control circuits 410, a target hand position storing circuit 409, a drive judging circuit 408 and so on respectively.

The target hand position storing circuit 409 is constituted of a counter and so on.

For example, when a start signal is inputted, an interruption signal generating control signal C is outputted to the chronograph interruption generating circuit 403 and a drive waiting signal G which will be explained hereinafter is outputted to the drive judging circuit 408.

When lap operation is inputted, a lap control signal B is outputted to the chronograph counter 404 in order to output the present value to a lap time calculating circuit 406 and the chronograph storing circuit 405. As well, when lap operation is inputted, the former chronograph value which is stored when the former lap operation is inputted in the chronograph storing circuit 405 is outputted to the lap time calculating circuit 406, and a lap control signal B for storing the latest chronograph counter value which is inputted from the chronograph counter 404 is outputted.

The chronograph interruption generating circuit 403 outputs a chronograph interruption signal E to the chronograph counter 404 and the drive judging circuit 408 at arbitrary intervals according to an interruption signal generating control signal C which is outputted from the system control circuit 402.

In this embodiment, a chronograph interrupting signal E is outputted to the drive judging circuit 408 each second and to the chronograph counter 404 each 1/10 second.

The chronograph counter 404 counts the chronograph interrupting signal E and thereby counts a total value of chronographic measurement.

The chronograph counter 404 outputs the present chronograph value to the lap time calculating circuit 406 and the chronograph storing circuit 405 when a lap control signal B is inputted from the system control circuit 402.

The chronograph storing circuit 405 usually stores the former chronograph value which is stored when the former lap control signal B is inputted.

The chronograph storing circuit 405 outputs the former chronograph value stored therein to the lap time calculating circuit 406 when a lap control signal B is newly inputted thereto.

The chronograph storing circuit 405 stores a new data of chronographic measurement newly outputted from the chronograph counter 404.

The chronograph storing circuit 405 is reset and stores zero at starting operation of chronographic measurement.

The lap time calculating circuit 406 begins to operate in response to a lap control signal B outputted from the system control circuit 402.

Figure 5:
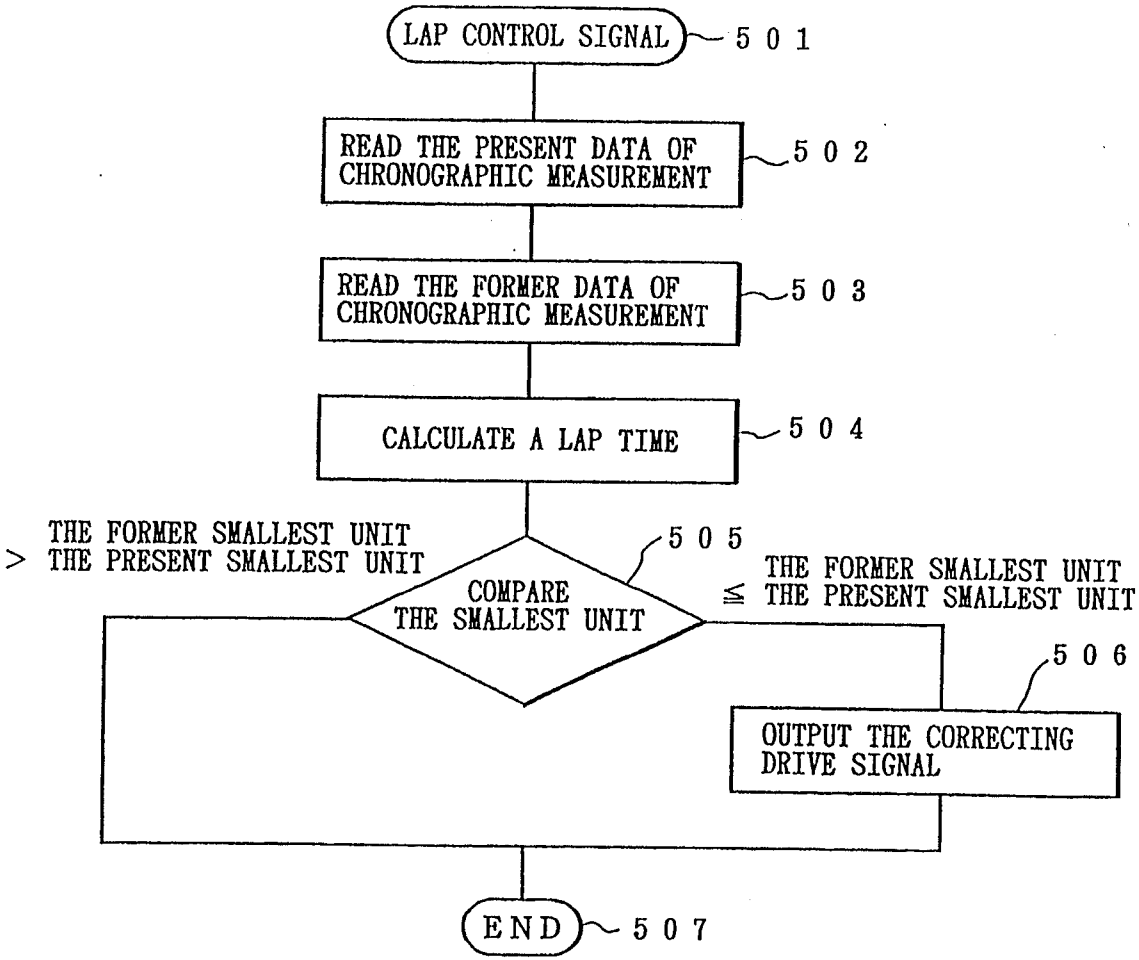
FIG. 5 is a flow chart showing the operation of the lap time calculating means of the present invention by a soft program.

FIG. 5 is a schematic flow chart showing the lap time calculating circuit 406 embodied by a soft program.

When a lap control signal B is inputted (Step 501), the present data of chronographic measurement outputted from the chronograph counter 404 and the former data of chronographic measurement outputted from the chronograph storing circuit 405 are supplied to the lap time calculating circuit 406 (Steps 502 and 503), which then calculates a lap time in accordance with the following formula (Step 504):

(The present data of chronographic measurement)
— (The former data of chronographic measurement).

Next, the value in the smallest unit of chronographic measurement are compared (Step 505).

In this embodiment, the smallest unit of lap display is 1 second and that of chronographic measurement is 1/10 second, so the values are compared in 1/10 second digit.

In this case, when the value of the former chronographic measurement data in 1/10 second digit is larger than that of the present chronograph measurement data in 1/10 second digit and a carry signal has been generated by the calculation in the step 504, the operation is ended. (Step 507)

When the value of the present chronographic measurement data in 1/10 second digit is larger than or equals to that of the former chronographic measurement data in the 1/10 second digit and a carry signal has not generated by the calculation in the Step 504, the operation is ended (Step 507) after outputting a correcting drive signal F for conducting correcting drive to the drive judging circuit 408. (Step 506)

A drive waiting signal G outputted from the system control circuit 402, a chronograph interrupting signal E outputted from the chronograph interruption generating circuit 403, and a correcting drive signal F outputted from the lap time calculating circuit 406 are inputted to the drive judging circuit 408.

The drive judging circuit 408 judges whether drive is to be conducted and as a result, if drive is conducted, outputs the data corresponding to the drive number.

Figure 6:
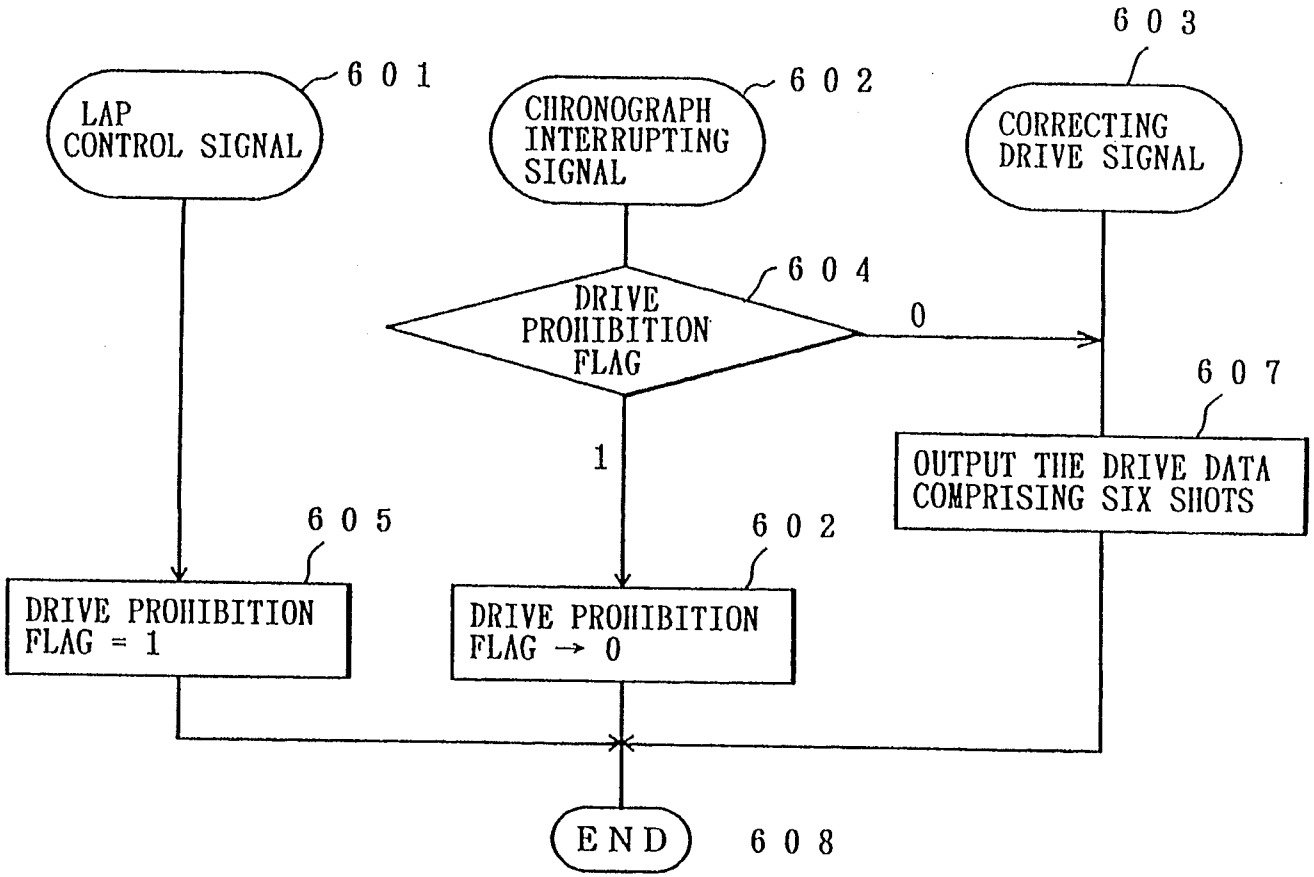
FIG. 6 is a flow chart showing the operation of the drive judging means of the present invention by a soft program.

FIG. 6 is a schematic flow chart showing operation of the drive judging circuit 408 embodied by a soft program.

If a drive waiting signal G is inputted to the drive judging circuit 408 when measurement begins (Step 601), a drive prohibition flag is also generated (Step 605) so as to end the operation (Step 608).

When chronographic measurement begins and a chronograph interrupting signals E are supplied to the drive judging circuit 408 each second (Step 602), the drive judging circuit 408 judges whether the drive prohibition flag stands or not (Step 604) and as a result if the drive prohibition flag stands, knocks the flag down so as to end the operation (Step 608).

In other words, when a first chronograph interrupting signal E is inputted since lap measurement begins, the drive judging circuit 408 ends the operation thereof without outputting the drive data to the target hand position storing circuit 409.

Thus, it follows that drive of the hand is not conducted and is delayed for on interrupt period. When lap operation or stop operation of chronographic measurement is conducted, the lap time calculating circuit 406 calculates a lap time.

In this stage, when a correcting drive signal F is inputted because the value of 1/10 second digit in the former data is larger (Step 603), the drive data comprising six shots, which correspond to a correcting drive pulse for one second, is outputted to the target hand position storing circuit 409 (Step 607), and then the operation is ended (Step 608).

When the drive data is outputted, the target hand position storing circuit 409 calculates the position to which the hand must be advanced and the drive control circuit 410 calculates a necessary drive number with data representing in the present had position storing circuit a present hand position storing circuit 407.

Figure 7:
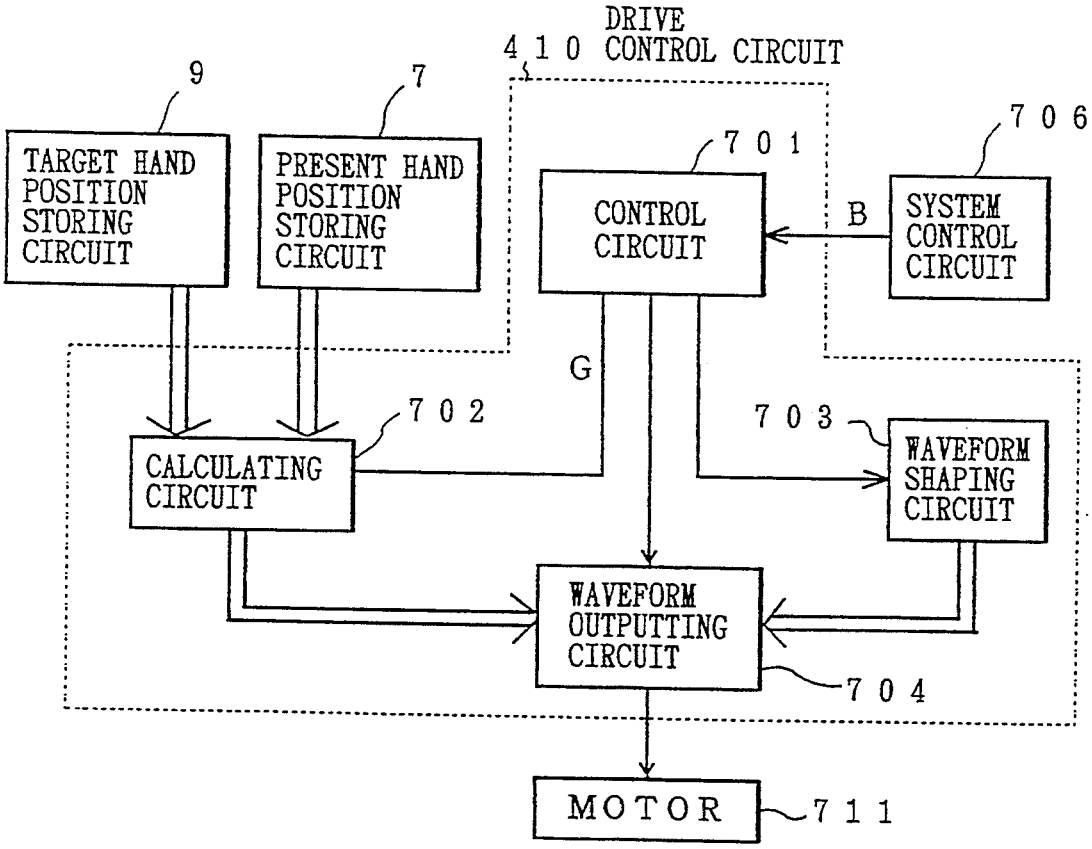
FIG. 7 is a structual diagram showing a drive control means of the present invention.

A circuit block diagram of the drive control circuit 410 is shown with FIG. 7.

The drive control circuit 410 comprises a control circuit 701 for controlling a transfer of the data and output of a drive control signal, a calculating circuit 702 for calculating a data of a drive number, a waveform shaping circuit 703 for outputting a driving pulse to a motor of a hand, and a waveform outputting circuit 704 for outputting pulses of a required number.

The control circuit 701, when a lap control signal B is inputted from the system control circuit 402 thereto, inputs each data from the present hand position storing circuit 407 and the target hand position storing circuit 409, and then outputs a drive amount calculating signal G for calculating the number of drive pulses which is necessary to transfer the hand to the calculating circuit 702.

The calculating circuit 702 outputs the data of the number of drive pulses to the waveform outputting circuit 704 after calculating the number of drive pulses.

The waveform outputting circuit 704 comprises a counter and so on. The waveform outputting circuit 704 sets a data of the number of drive pulses to the counter, and then substrates a counter value every time it outputs a waveform outputted from the waveform shaping circuit 703 to a motor 711. When the counter value becomes zero, the waveform outputting circuit 704 stops outputting a waveform so as to end predetermined drive.

A flow of operation will be explained with concrete numerical values.

Figure 8:
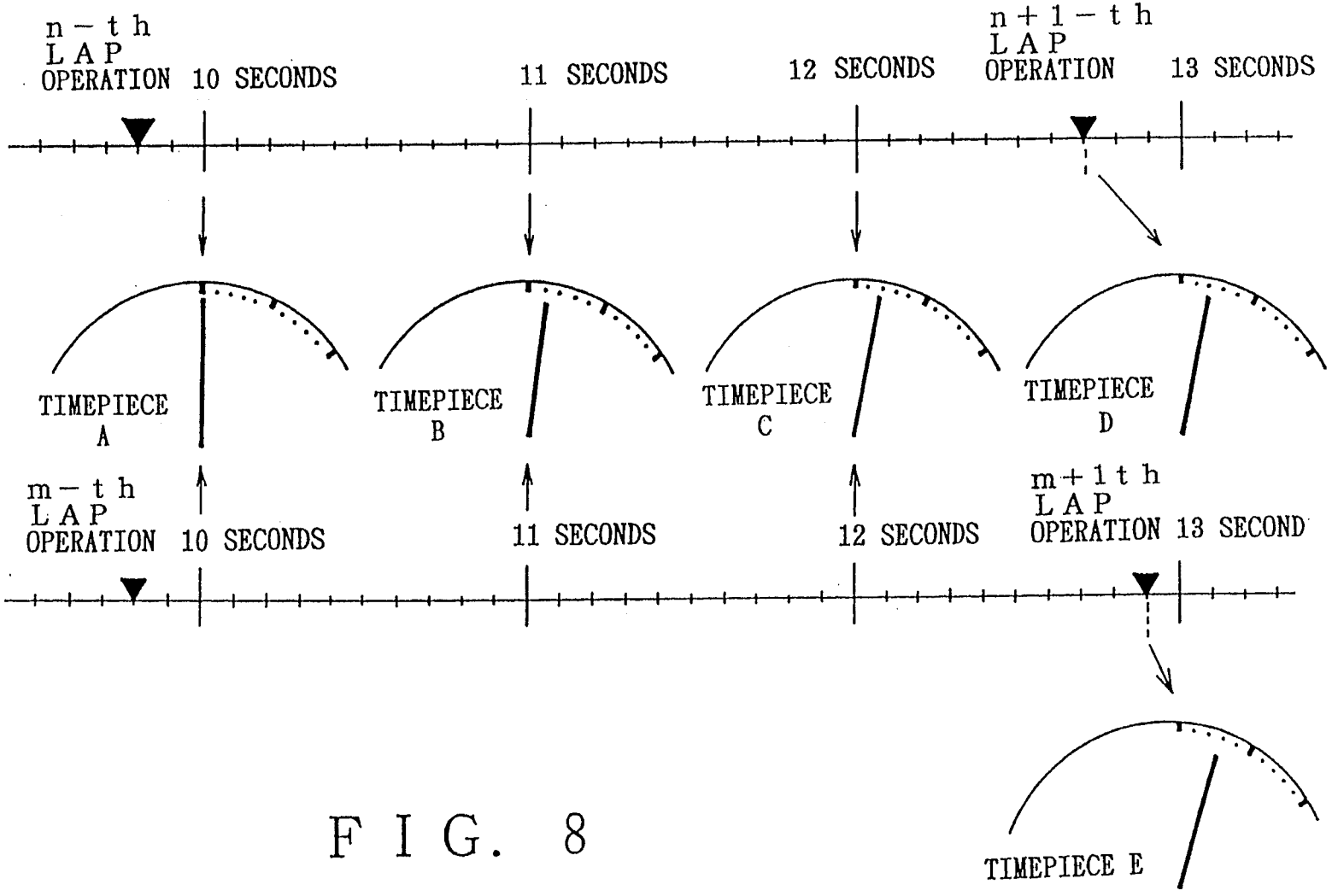
FIG. 8 is an explanatory diagram showing operation of the present invention.

FIG. 8 is an explanatory diagram showing movement of the hand when lap operation is conducted n times, n+1 times, m times, and m+1 times.

In FIG. 8, suppose that n-th lap operation is inputted when the data of chronographic measurement is 9.8 second. The chronograph storing circuit 405 stores the data of 9.8 second. The drive judging circuit 408 sets a drive prohibition flag therein.

Next, a chronograph interruption signal E is inputted from the chronograph interruption generating circuit 403 to the drive judging circuit 408 at ten seconds after chronographic measurement begins.

Then the drive judging circuit 408 resets the drive prohibition flag which has been set until then, and stops its operation without conducting drive of the hand. Therefore the hand displaying lap time doesn't move and keeps on indicating zero, as shown in a timepiece—A.

Next, a chronograph interruption signal E is inputted from the chronograph interruption generating circuit 403 to the drive judging circuit 408 at the eleventh second most after chronographic measurement begins. The drive prohibition flag has been reset and therefore drive data comprising six steps which are drive steps corresponding to a display lap time of one second is outputted to the driving circuit 12. The driving circuit 12 outputs drive waveforms for six steps according to the preceding operation. Consequently, the timepiece B displaying lap time indicates one second.

When the twelve second chronograph interruption signal E is inputted to the drive judging circuit 408, a similar operation is conducted and the timepiece C displaying the lap time indicates a lap time of two seconds.

Next, if an (n+1)th lap operation is conducted when the chronographic measurement time is 12.7 seconds, the chronograph counter 404 outputs the data of 12.7 seconds which indicates the present chronographic measurement data, to the chronograph storing circuit 405 and the lap time calculating circuit 406. The chronograph storing circuit 405 outputs the data of 9.8 seconds which indicates the former chronographic measurement data stored therein at that time, to the lap time calculating circuit 406. The chronograph storing circuit 405 the stores the present chronographic measurement data, 12.7 seconds.

The lap time calculating circuit 406 calculates (n+1)th lap data with each chronographic measurement data, 9.8 seconds and 12.7 seconds.

The lap time calculating circuit 406 compares values in 1/10 second digit. In this case, the former data indicates 8 and the present data indicates 7, so the former data is larger than the other. Therefore correcting drive is not outputted and the operation is ended. At that time, the hand remains at two seconds to which the hand has transferred at the twelfth chronographic interruption signal and doesn't move any more. Hence (n+1)th lap time indicates two seconds.

An actual lap time is as follows; 12.7 seconds−9.8 seconds=2.9 seconds. However, if the fractions in the smallest digit are dropped according to the specification of this product, the hand displays a lap time exactly.

Then, similarly, a description will be given for the case that an m-th lap operation is inputted when a chronographic measurement data is 9.8 seconds and further an (m+1)th lap operation is inputted when a chronographic measurement data is 12.9 seconds.

The timepiece acts similarly until 12 seconds and the hands display the identical lap time in the timepieces A, B, and C.

Next, if an (m+1)th lap operation is inputted when the elapsed time of chronograph measurement is 12.9 seconds, the chronograph counter 404 outputs the present chronographic measurement data of 12.9 seconds to the chronograph storing circuit 405 and the lap time calculating circuit 406.

The chronograph storing circuit 405 outputs the former chronographic measurement data of 10.8 seconds, which is stored therein at that time, to the lap time calculating circuit 406.

The chronograph storing circuit 405 stores newly the data of 12.9 seconds which indicates the latest chronographic measurement.

The lap time calculating circuit 406 calculates the (n+1)th lap data from each chronographic measurement data, 12.9 seconds and 9.8 seconds and further compares the values in a 1/10 second digit.

In this case, the former data is 8 and the present data is 9, so the present data is larger than the former.

Therefore, a correcting drive signal F is outputted to the drive judging circuit 408 and then the operation is ended. The drive judging circuit 408 to which the correcting drive signal F is inputted outputs a drive data comprising six steps which are transferring steps for one second to the motor 711. The motor 711 to which the drive data is inputted advances the hand for one second through a gear train and so on.

Therefore the hand is transferred from the position of two seconds, to which the hand is moved when the twelfth chronographic interruption is generated, to the position of three seconds. As shown with the timepiece E, (m+1)th lap time is three seconds.

The actual time is as follows.

12.9 seconds−9.8 seconds=3.1 seconds. However, the timepiece indicates a lap time correctly according to the specification of the product.

As described above, the inventive timepiece with chronographic function comprises the system control means for outputting a control signal to each means in response to a signal inputted from the outer inputting means, the chronograph storing means for storing a value of the chronograph measuring means by a lap control signal outputted from the system control means, the lap time calculating means to which a measurement data of the chronographic measuring means and a former measuring data stored in the chronographic storing means by a former lap control signal are inputted for calculating the time difference between the above two measuring data and outputting a correcting drive signal if correcting drive is required for the hand as a result of the above calculation, and the drive judging means to which a lap input signal, an interruption signal, and a correcting drive signal each of which are outputted from the system control means are inputted for outputting the data of a drive number if the hand requires driving. Therefore, the hand reversion driving circuit is not required to provide to the inventive timepiece. As well, the chronograph interruption generating means and the chronograph measuring means do not require to be reset at each switching input. Consequently, the inventive timepiece can display a lap time correctly with the hand moving naturally.

What is claimed is:

1. An electronic timepiece, comprising:

control means for generating a control signal in response to a manual input operation;

interrupt generating means for outputting interrupt signals on a periodic basis in response to the control signal;

counting means for counting the interrupt signals and for producing a count value;

storing means for storing a time value in response to said control signal;

lap time calculating means for calculating a lap time by calculating the difference between a time corresponding to an end of a lap measurement and a stored time value corresponding to a start of a lap measurement and for outputting a correcting drive signal;

driving means to which the output signal of the lap time calculating means and the interrupt signals are input for controlling display means; and display means for displaying an elapsed lap time.

2. An electronic timepiece according to claim 1, wherein the driving means comprises:

target hand position storing means for storing data corresponding to a target hand position;

present hand position storing means for storing data corresponding to a present hand position; and hand position calculating means to which the data of the target hand position storing means and present hand position storing means is supplied, for determining a driving signal for driving a hand of the display means.

3. An electronic timepiece according to claim 1, wherein the lap time calculating means calculates lap time by subtracting time values in the smallest unit of chronographic measurement.

4. An electronic timepiece according to claim 1, wherein the driving means is receptive of the correcting drive signal and advances an indicator hand of the display means for one second in response thereto.

5. An electronic timepiece according to claim 1, wherein said time corresponding to an end of a lap measurement is determined in accordance with the stored time value corresponding to a start of a lap measurement and the count value.

6. An electronic timepiece according to claim 1, wherein the lap time calculating means issues said correcting drive signal when the calculated lap time is greater than the displayed elapsed lap time.

7. An electronic timepiece, comprising:

manually operable input means for generating an input signal commencing chronographic measurement;

control means for receiving the input signal and for generating a lap control signal for initiation of a lap time measurement;

means for generating interrupt signals on a periodic basis in response to the control signal;

counting means for counting the interrupt signals and for producing a count value;

storing means for storing current time data in response to the lap control signal;

lap time calculating means for receiving the store, current time data from the storing means and for calculating lap time by subtracting a stored time data corresponding to a start of a lap time measurement from a time corresponding to an end of a lap time measurement, and for outputting a correcting drive signal when there is a difference between a displayed lap time and the calculated lap time;

drive judging means receptive of the lap control signal for prohibiting an indicator hand from driving for a first interrupt period in a lap measurement, for providing an output signal for driving the indicator hand in response to subsequent interrupt periods, and for providing an output signal corresponding to a drive amount required for driving the indicator hand when there is a difference between the displayed lap time and the calculated lap time; and driving means for receiving the output signal of the drive judging means for driving the indicator hand.

8. An electronic timepiece according to claim 7, wherein the driving means comprises:

target hand position storing means for storing data corresponding to a target hand position;

present hand position storing means for storing data corresponding to a present hand position; and hand position calculating means for receiving the data of the target hand position storing means and present hand position storing means and for calculating a corresponding driving signal for driving the indicator hand.

9. An electronic timepiece according to claim 7, wherein the lap time calculating means calculates lap time by subtracting respective stored the time data values in the smallest unit of chronographic measurement.

10. An electronic timepiece according to claim 7, wherein the driving means is receptive of the correcting drive signal and advances the indicator hand of the display means for one second in response thereto.

11. An electronic timepiece according to claim 7, wherein said time corresponding to an end of a lap measurement is determined in accordance with the stored time data corresponding to a start of a lap measurement and the count value.

* * * * *